US006393749B1

(12) United States Patent
Haupt

(10) Patent No.: US 6,393,749 B1
(45) Date of Patent: May 28, 2002

(54) NAPKIN/PICTURE HOLDER

(76) Inventor: Thomas M. Haupt, 198 Dallas St., Lindenhurst, NY (US) 11757

( * ) Notice: Subject to any disclaimer, the term of this patent is extended or adjusted under 35 U.S.C. 154(b) by 0 days.

(21) Appl. No.: 09/552,792

(22) Filed: Apr. 20, 2000

(51) Int. Cl.[7] ..... A47G 1/06

(52) U.S. Cl. ..... 40/725; 40/734; 40/747; 40/765

(58) Field of Search ..... 40/725, 661, 649, 40/506, 493, 734, 765, 747, 661.08; D7/631; 24/7

(56) References Cited

U.S. PATENT DOCUMENTS 1,400,564 A * 12/1921 Metzger ..... 248/473
2,177,187 A * 10/1939 Olsen ..... 40/658
2,323,892 A * 7/1943 Bricker ..... 211/42
D191,592 S * 10/1961 Wolf et al. ..... D7/631
D209,314 S * 11/1967 Appel et al. ..... D7/631
3,771,246 A * 11/1973 Ebner ..... 40/720
3,953,014 A * 4/1976 Mendell, Jr. ..... 269/43
4,301,608 A * 11/1981 Taylor, Jr. ..... 40/661
4,326,349 A * 4/1982 Daughtry ..... 40/733
5,309,657 A * 5/1994 Spencer ..... 40/473
5,342,057 A * 8/1994 Sorkoram ..... 273/239
5,433,036 A * 7/1995 Ganal ..... 40/729
5,448,844 A * 9/1995 Miller, Jr. et al. ..... 40/611
D364,042 S * 11/1995 Chavez et al. ..... D6/314

* cited by examiner

*Primary Examiner*—Jack Lavinder
*Assistant Examiner*—William L. Miller

(57) ABSTRACT

A napkin/picture holder for storing napkins in an attractive manner. The napkin/picture holder includes a support having a bottom wall and a pair of side walls integrally attached to either side of the bottom wall and extending upwardly and each having a main portion and a wing portion which is turned over upon and spaces from the main portion to form a picture-receiving slot therebetween. The side walls are spaced from one another to essentially form a napkin-receiving slot therebetween. As a second embodiment, the bottom wall is supported upon a base member having an upper portion which swivels relative to the base portion. As a third embodiment, a plurality of ring members are attached to the side walls and are adapted to hold and store selected usable accessories. As a fourth embodiment, one of the side walls is spring-loaded and hingedly attached to the side of the bottom wall and is engageable with napkins placed between the side walls. As a fifth embodiment, a pair of leaf members are hingedly attached to the side walls and have picture-receiving slits.

9 Claims, 3 Drawing Sheets

NAPKIN/PICTURE HOLDER

BACKGROUND OF THE INVENTION

1. Field of the Invention

The present invention relates to a napkin and other accessories holder and more particularly pertains to a new napkin/picture holder for storing napkins in an attractive manner.

2. Description of the Prior Art

The use of napkin and other accessories holder is known in the prior art. More specifically, napkin and other accessories holder heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,177,187; U.S. Pat. No. 3,953,014; U.S. Pat. No. 5,448,844; U.S. Pat. No. 1,400,564; U.S. Pat. No. Des. 191,592; and U.S. Pat. No. Des. 209,314.

While these devices fulfill their respective, particular objectives and requirements, the aforementioned patents do not disclose a new napkin/picture holder. The inventive device includes a support having a bottom wall and a pair of side walls integrally attached to either side of the bottom wall and extending upwardly and each having a main portion and a wing portion which is turned over upon and spaced from the main portion to form a picture-receiving slot therebetween. The side walls are spaced from one another to essentially form a napkin-receiving slot therebetween. As a second embodiment, the bottom wall is supported upon a base member having an upper portion which swivels relative to the base portion. As a third embodiment, a plurality of ring members are attached to the side walls and are adapted to hold and store selected usable accessories. As a fourth embodiment, one of the side walls is spring-loaded and hingedly attached to the side of the bottom wall and is engageable with napkins placed between the side walls. As a fifth embodiment, a pair of leaf members are hingedly attached to the side walls and have picture-receiving slits.

In these respects, the napkin/picture holder according to the present invention substantially departs from the conventional concepts and designs of the prior art, and in so doing provides an apparatus primarily developed for the purpose of storing napkins in an attractive manner.

SUMMARY OF THE INVENTION

In view of the foregoing disadvantages inherent in the known types of napkin and other accessories holder now present in the prior art, the present invention provides a new napkin/picture holder construction wherein the same can be utilized for storing napkins in an attractive manner.

The general purpose of the present invention, which will be described subsequently in greater detail, is to provide a new napkin/picture holder which has many of the advantages of the napkin and other accessories holder mentioned heretofore and many novel features that result in a new napkin/picture holder which is not anticipated, rendered obvious, suggested, or even implied by any of the prior art napkin and other accessories holder, either alone or in any combination thereof.

To attain this, the present invention generally comprises a support having a bottom wall and a pair of side walls integrally attached to either side of the bottom wall and extending upwardly and each having a main portion and a wing portion which is turned over upon and spaced from the main portion to form a picture-receiving slot therebetween. The side walls are spaced from one another to essentially form a napkin-receiving slot therebetween. As a second embodiment, the bottom wall is supported upon a base member having an upper portion which swivels relative to the base portion. As a third embodiment, a plurality of ring members are attached to the side walls and are adapted to hold and store selected usable accessories. As a fourth embodiment, one of the side walls is spring-loaded and hingedly attached to the side of the bottom wall and is engageable with napkins placed between the side walls. As a fifth embodiment, a pair of leaf members are hingedly attached to the side walls and have picture-receiving slits.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new napkin/picture holder which has many of the advantages of the napkin and other accessories holder mentioned heretofore and many novel features that result in a new napkin/picture holder which is not anticipated, rendered obvious, suggested, or even implied by any of the prior art napkin and other accessories holder, either alone or in any combination thereof.

It is another object of the present invention to provide a new napkin/picture holder which may be easily and efficiently manufactured and marketed.

It is a further object of the present invention to provide a new napkin/picture holder which is of a durable and reliable construction.

An even further object of the present invention is to provide a new napkin/picture holder which is susceptible of a low cost of manufacture with regard to both materials and labor, and which accordingly is then susceptible of low prices of sale to the consuming public, thereby making such napkin/picture holder economically available to-the buying public.

Still yet another object of the present invention is to provide a new napkin/picture holder which provides in the apparatuses and methods of the prior art some of the advantages thereof, while simultaneously overcoming some of the disadvantages normally associated therewith.

Still another object of the present invention is to provide a new napkin/picture holder for storing napkins in an attractive manner.

Yet another object of the present invention is to provide a new napkin/picture holder which includes a support having a bottom wall and a pair of side walls integrally attached to either side of the bottom wall and extending upwardly and each having a main portion and a wing portion which is turned over upon and spaced from the main portion to form a picture-receiving slot therebetween. The side walls are spaced from one another to essentially form a napkin-receiving slot therebetween. As a second embodiment, the bottom wall is supported upon a base member having an upper portion which swivels relative to the base portion. As a third embodiment, a plurality of ring members are attached to the side walls and are adapted to hold and store selected usable accessories. As a fourth embodiment, one of the side walls is spring-loaded and hingedly attached to the side of the bottom wall and is engageable with napkins placed between the side walls. As a fifth embodiment, a pair of leaf members are hingedly attached to the side walls and have picture-receiving slits.

Still yet another object of the present invention is to provide a new napkin/picture holder that conveniently stores napkins and functions as a picture frame.

Even still another object of the present invention is to provide a new napkin/picture holder that conveniently stores selected accessories useful for the table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
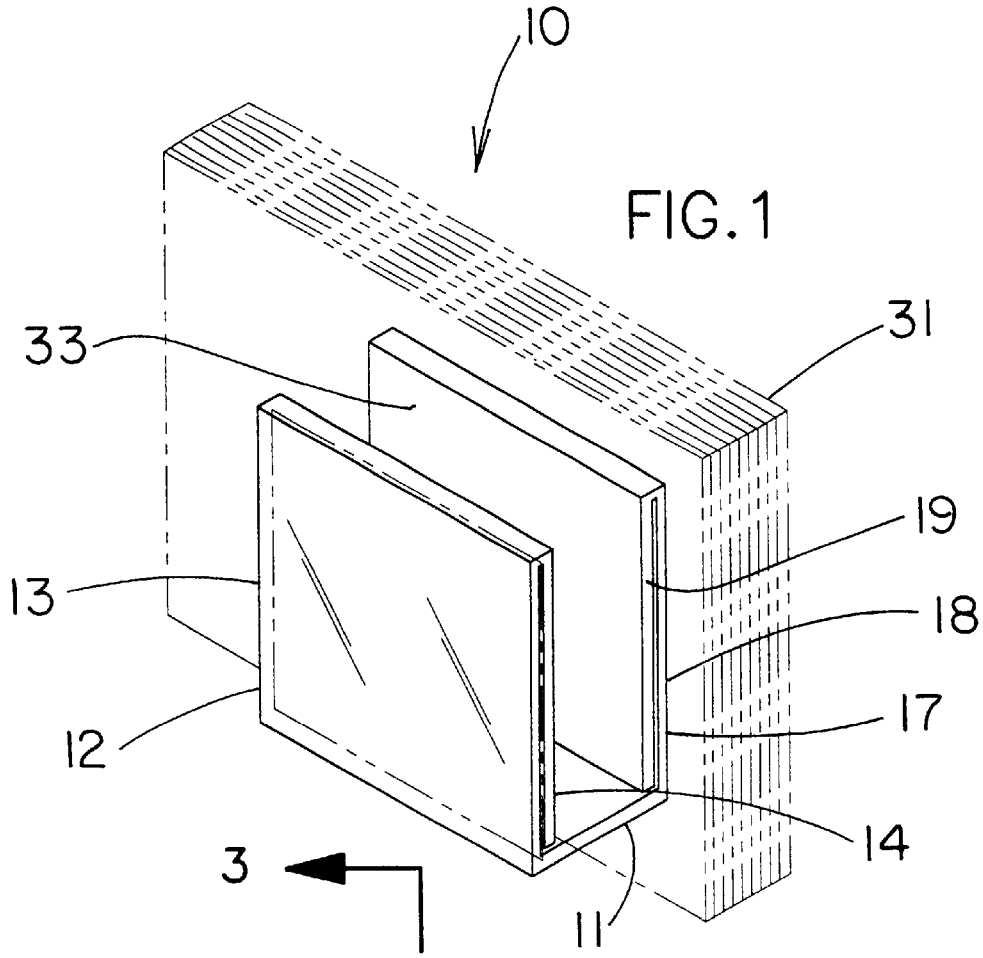
FIG. 1 is a perspective view of the first embodiment of a new napkin/picture holder according to the present invention.
Figure 2:
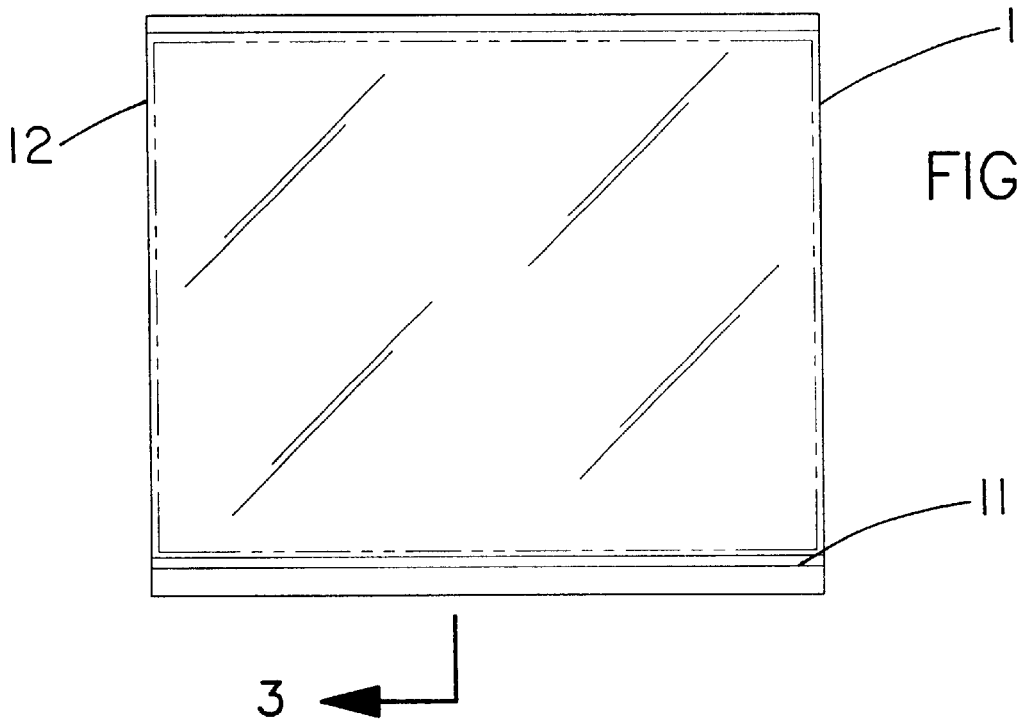
FIG. 2 is a side elevational view of the first embodiment of the present invention.
Figure 3:
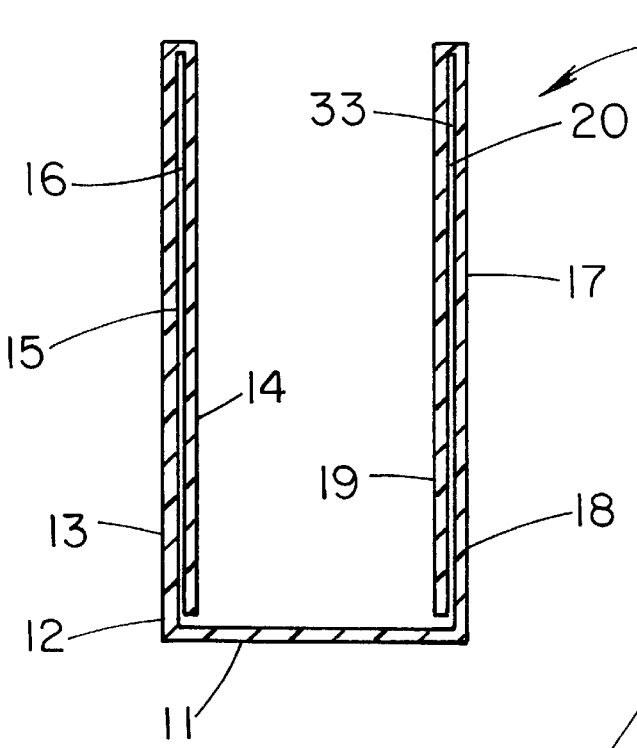
FIG. 3 is an end elevational view of the first embodiment of the present invention.
Figure 4:
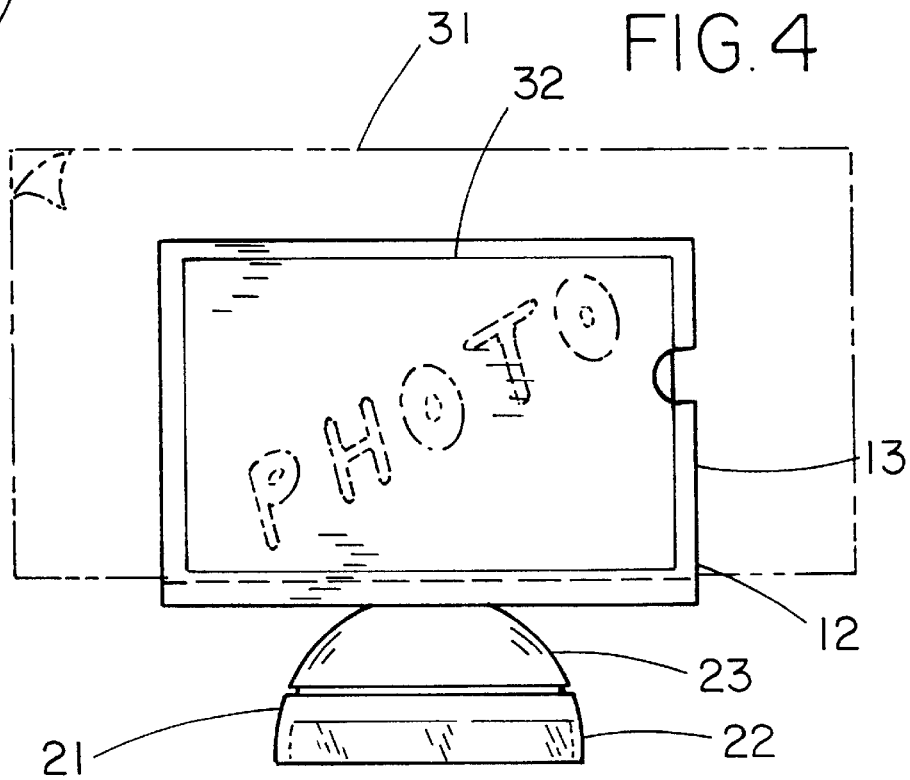
FIG. 4 is a side elevational view of the second embodiment of the present invention.
Figure 5:
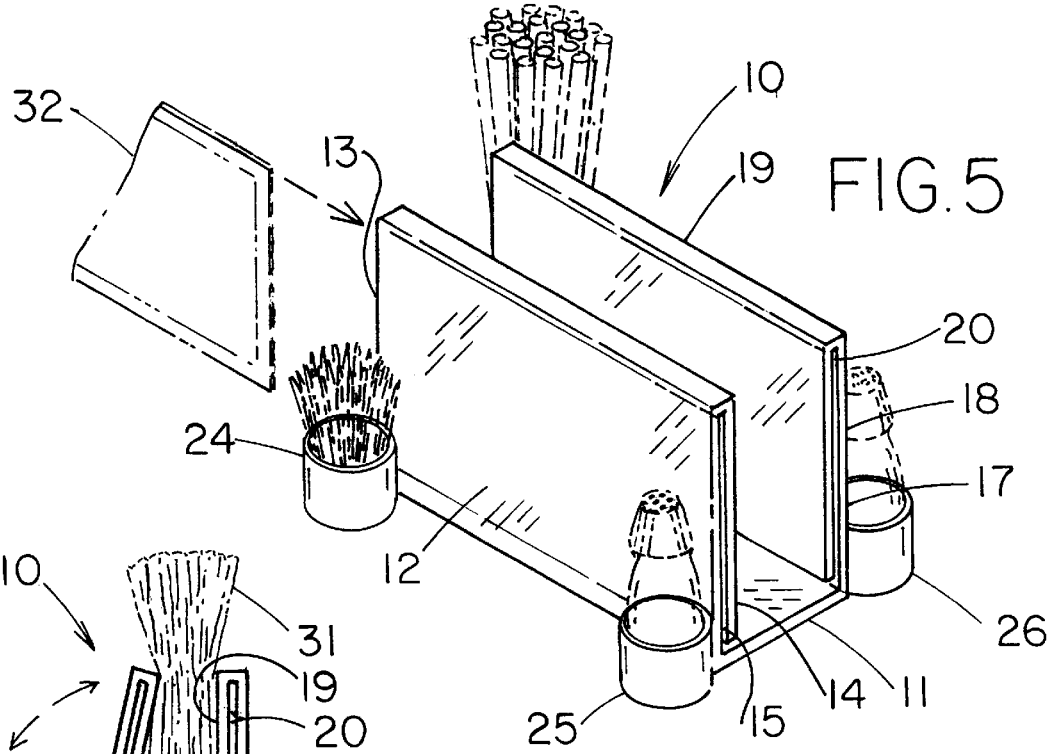
FIG. 5 is a perspective view of the third embodiment of the present invention.
Figure 6:
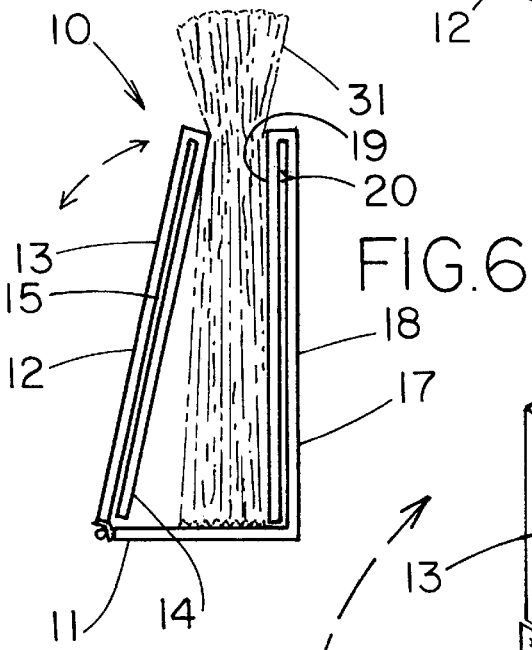
FIG. 6 is an end elevational view of the fourth embodiment of the present invention.
Figure 7:
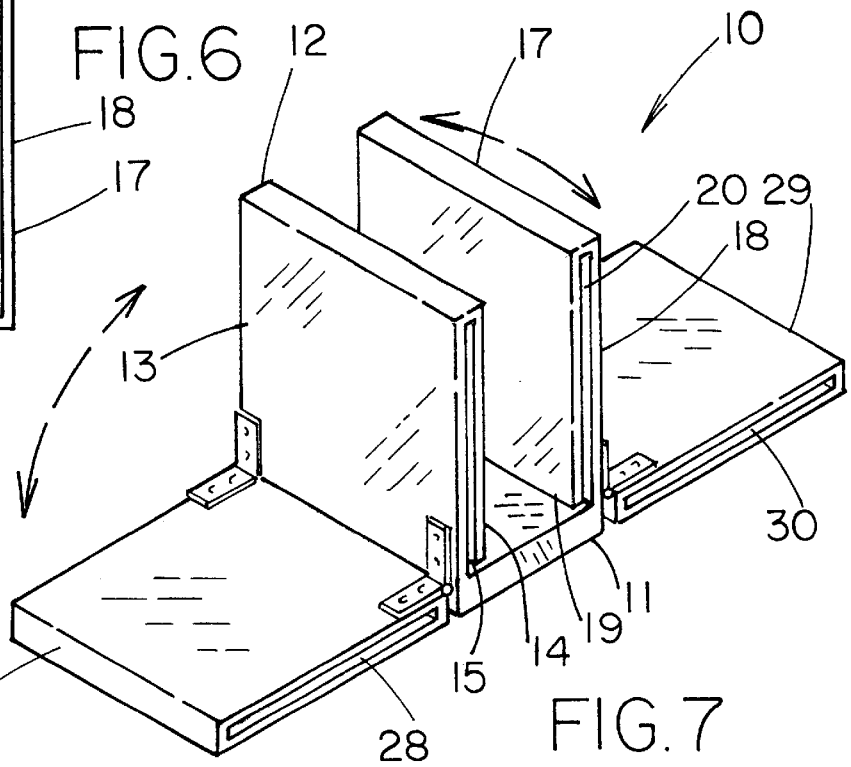
FIG. 7 is a perspective view of the fifth embodiment of the present invention.

With reference now to the drawings, and in particular to FIGS. 1 through 7 thereof, a new napkin/picture holder embodying the principles and concepts of the present invention and generally designated by the reference numeral 10 will be described.

As best illustrated in FIGS. 1 through 7, the napkin/picture holder 10 generally comprises a support means including a bottom wall 11 and a pair of upstanding side walls 12,17 integrally connected to either side of the bottom wall 11. Each of the side walls 12,17 has a main portion 13,18 and a wing portion 14,19 which is turned over upon the main portion 13,18. The main portion 13,18 and the wing portion 14,19 are spaced from one another thus forming a picture-receiving slot 15,20 therebetween. Also, the side walls 12,17 are spaced from another thus forming a napkin-holding slot therebetween. Each of the main portions 13,18 of the side walls 12,17 has an inner side 16,33 which faces inwardly of the support means with the inner sides 16,33 of the main portions 13,18 facing each other. Each of the wing portions 14,19 is turned over upon and spaced from the inner side 16,33 of a respective main portion 13,18 with each of the side walls 12,17 being transparent. The support means essentially has a height of approximately 3½ inches, a length of approximately 5 inches, and a width of approximately 2¼ inches.

As a second embodiment, the support means includes a base member 21 upon which the bottom wall 11 is securely and conventionally mounted. The base member 21 includes a weighted base portion 22 and an upper portion 23 which is swivelly mounted upon the base portion 22 with the bottom wall 11 of the support means being securely mounted upon the base portion 22.

As a third embodiment, the support means includes a plurality of ring-like members 24–26 securely attached to outer sides of the main portions 13,18 of the side walls 12,17 for retaining and supporting selected objects. The ring-like members 24–26 include a first two ring-like members being disposed at one end and near a bottom of the side walls 12,17 and also includes a second two ring-like members being disposed at the other end and near a bottom of the side walls 12,17. The ring-like members 24–26 are adapted to hold toothpicks, salt and pepper containers, and straws.

As a fourth embodiment, one of the side walls 12 is spring-loaded and hingedly attached to the bottom wall 11. The spring-loaded side wall 12 is biased toward the other of the side walls 17 for engaging napkins 31 between the side walls 12,17 with the spring-loaded side wall 12 having a bottom end which is hingedly attached to one of the sides of the bottom wall 11.

As a fifth embodiment, the support means includes a pair of leaf members 27,29 one of which hingedly attached to an outer side of one of the side walls 12 and the other of which is hingedly attached to an outer side of the other of the side walls 17. Each of the leaf members 27,29 includes a planar member having a longitudinal picture-receiving slit 28,30 extending therethrough from one end to the other end thereof with each of the leaf members 27,29 being capable of being disposed parallel to the bottom wall 11 and being disposed perpendicular to the bottom wall 11.

In use, the napkin/picture holder 10 is essentially placed upon a table, and napkins 31 are placed in the napkin-receiving slot between the side walls 12,17, and pictures 32 or photographs can be placed in the picture-receiving slots 15,20 of the side walls 12,17.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A napkin and picture holder comprising:

a support including a bottom wall having opposite sides and a pair of upstanding side walls each being integrally connected to one of said sides of said bottom wall, wherein at least one of said side walls includes a main portion and a wing portion, said main portion and said wing portion being spaced from each other to form a picture-receiving slot therebetween for receiving a picture therein, wherein said side walls are mounted on said bottom wall such that said side walls are substantially immovable with respect to said bottom wall and to each other to form a napkin-holding slot therebetween of substantially fixed width therebetween.

2. A napkin and picture holder as described in claim 1, wherein each of said side walls comprises a said main portion and a said wing portion, each of said main portions of said side walls has an inner side which faces inwardly of said support, said inner sides of said main portions facing each other.

3. A napkin and picture holder as described in claim 2, wherein each of said wing portions is turned over upon and spaced from said inner side of a respective said main portion.

4. A napkin and picture holder as described in claim 2, wherein the wing portions of said side walls being opposed to each other, and the main portions of said side walls being on opposite sides of said wing portions.

5. A napkin and picture holder as described in claim 1, wherein each of said side walls is transparent.

6. A napkin and picture holder as described in claim 1, wherein said support further includes a base member upon which said bottom wall is mounted.

7. A napkin and picture holder as described in claim 6, wherein said base member includes a weighted base portion and an upper portion which is swivelly mounted upon said base portion.

8. A napkin and picture holder as described in claim 1, wherein said bottom wall forms a bottom of said picture-receiving slot formed by said main and wing portions of said at least one side wall.

9. A napkin and picture holder comprising:

a support including a bottom wall having opposite sides and a pair of upstanding side walls each being integrally connected to one of said sides of said bottom wall, wherein at least one of said side walls includes a main portion and a wing portion, said main portion and said wing portion being spaced from each other to form a picture-receiving slot therebetween for receiving a picture therein, wherein said side walls are mounted on said bottom wall such that said side walls are substantially immovable with respect to said bottom wall and to each other to form a napkin-holding slot therebetween of substantially fixed width therebetween;

wherein each of said side walls comprises a said main portion and a said wing portion, each of said main portions of said side walls has an inner side which faces inwardly of said support, said inner sides of said main portions facing each other;

wherein each of said wing portions is turned over upon and spaced from said inner side of a respective said main portion;

wherein each of said side walls is transparent;

wherein said support further includes a base member upon which said bottom wall is mounted;

wherein said base member includes a weighted base portion and an upper portion which is swivelly mounted upon said base portion;

wherein said bottom wall forms a bottom of said picture-receiving slot formed by said main and wing portions of said at least one side wall; and wherein the wing portion of said side walls being opposed to each other, and the main portions of said side walls being on opposite sides of said wing portions.

* * * * *